United States Patent [19]

Linder

[11] 4,180,333

[45] Dec. 25, 1979

[54] BEARING FOR THE PRINTING HEAD OF A MATRIX PRINTER, AND PRINTING HEAD COMPRISING SUCH A BEARING

[75] Inventor: Uno K. E. Linder, Stockholm, Sweden

[73] Assignee: U.S. Philips Corporation, New York, N.Y.

[21] Appl. No.: 885,793

[22] Filed: Mar. 13, 1978

[30] Foreign Application Priority Data

Mar. 15, 1977 [SE] Sweden ..... 7702881

[51] Int. Cl.[2] ..... B41J 3/12

[52] U.S. Cl. ..... 400/124; 101/93.05

[58] Field of Search ..... 101/93.04, 93.05; 400/124

[56] References Cited

U.S. PATENT DOCUMENTS

| | | | |
|---|---|---|---|
| 3,467,232 | 9/1969 | Paige | 400/124 |
| 3,987,883 | 10/1976 | Darwin et al. | 400/124 |
| 3,991,870 | 11/1976 | McIntosh | 400/124 |
| 3,991,871 | 11/1976 | McIntosh | 400/124 |
| 4,009,772 | 3/1977 | Glaser et al. | 400/124 |
| 4,046,303 | 9/1977 | Reier et al. | 400/124 X |

*Primary Examiner*—Paul T. Sewell

*Attorney, Agent, or Firm*—Robert S. Smith

[57] ABSTRACT

A bearing for a printing head of a matrix printer whose slidable printing pins are guided in guide channels which are provided in a portion of the bearing which is made of a comparatively soft material. The bearing is provided with pin-shaped inserts which adjoin the guide channels and which are made of a comparatively hard material. A printing head comprising a bearing of this kind has a high-wear resistance and can be inexpensively manufactured.

5 Claims, 6 Drawing Figures

BEARING FOR THE PRINTING HEAD OF A MATRIX PRINTER, AND PRINTING HEAD COMPRISING SUCH A BEARING

BACKGROUND OF THE INVENTION

The invention relates to a bearing for the printing head of a matrix printer, of the type having a number of slidable printing pins which are journalled in the printing head and whose printing ends are situated in the vicinity of each other on a straight line which extends transversely of the direction of a line to be printed. A bearing which can be inserted into the printing head guides the pins near their printing ends. Such a bearing typically provides an individual, substantially straight guide channel for each printing pin, and includes a portion which is made of comparatively soft material and a portion which is made of comparatively hard material.

The invention furthermore relates to a printing head comprising such a bearing.

Very severe requirements are imposed on the mechanical parts of the printing head of comtemporary matrix printers, both the printing pins themselves and the bearings of the printing pins, particularly those operating at high printing speeds. The bearings of the printing pins should have a high wear resistance as well as a construction of low weight. Particularly the so-called nose bearing of the printing pins which is situated near the printing spot should have as low as possible a weight in view of the high speed at which the printing head is displaced along a record carrier. Therefore, the nose bearing of a printing head is preferably made partly of a synthetic material of the kind described, for example, in U.S. Pat. No. 3,991,870.

Bearings of the described kind are often used in printing heads of matrix printers in which the guide channels or movement paths of the printing pins have a curved shape. In printers of this kind the printing pins converge towards the printing spot. The converging printing pins are customarily guided over a comparatively short distance, near the printing spot, in straight guide channels provided in the nose bearing. The free ends of the printing pins which are intended for printing are situated on a vertical, straight line which extends transversely of the direction of a line to be printed. The movement paths of the outer printing pins (viewed in the nose bearing) are curved more than the movement paths of the printing pins situated nearer to the center, so that the walls of the outer guide channels are subject to more frictional wear than the walls of the other guide channels.

In order to reduce the wear of parts of the nose bearing, bearings of this kind in U.S. Pat. Nos. 3,991,870, 3,991,871 and 4,009,772 utilize inserts of a material which is substantially harder than the material used for the remainder of the nose bearing. The insert thus forms part of the nose bearing which can be replaced as a unit. The guide channels of the printing are formed in the very hard material of the inserts.

These known printing heads have the cast disadvantage that the provision of guide channels in the insert is an elaborate and hence comparatively expensive operation.

SUMMARY OF THE INVENTION

The object of the invention is to provide a bearing in which guide channels for the printing pins can be formed in a simple and inexpensive manner, which substantial wear resistance of the printing pins as well as the bearing is maintained.

To this end, in a bearing according to the invention is the comparatively soft portion of the insertable bearing comprises at least two substantially straight channels which are provided with a pin-shaped, comparatively hard insert and which extend parallel to the guide channels and are aligned on said straight line, viewed in a cross-section of the guide channels, one of the pin-shaped inserts substantially adjoining the one outer printing pin, and the other pin-shaped insert substantially adjoins the other outer printing pin. Because the guide channels in a bearing in accordance with the invention are formed in the comparatively soft portion of the bearing and the inserts are formed by loose, comparatively hard, pin-shaped parts which can be readily manufactured per se, a cheap and simple bearing can be realized which also has a high wear resistance.

The invention will be described in detail hereinafter with reference to the accompanying diagrammatic drawing.

DESCRIPTION OF THE PREFERRED EMBODIMENTS

Figure 1:
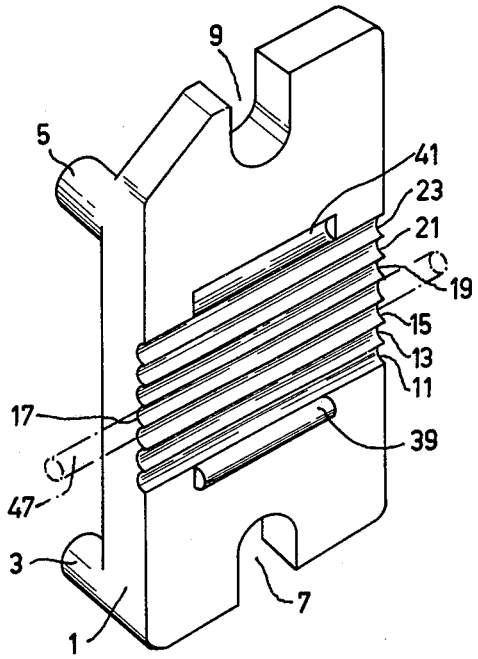
FIG. 1 is a perspective view of a part of a bearing in accordance with the invention which is intended for a printing head in accordance with the invention.
Figure 2:
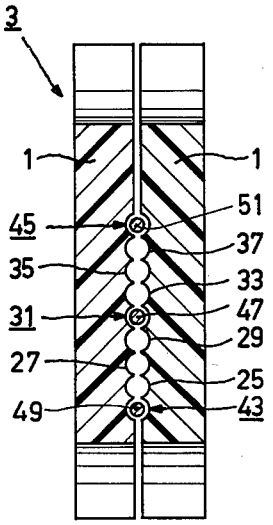
FIG. 2 is a cross-sectional view of two assembled bearing parts as shown in FIG. 1, which together form a first embodiment of a complete bearing in accordance with the invention.

The bearing half 1 which is shown in perspective in FIG. 1 is made of a comparatively soft material. This material may be a synthetic material of a customary, known type, as described in U.S. Pat. No. 3,991,870. A comparatively soft material is to be understood herein to mean a material which is comparatively soft in comparison with the materials of the inserts and printing pins to be described hereinafter. The bearing half 1 comprises projections 3 and 5 which serve for mounting the assembled bearing in a printing head in accordance with the invention (see FIGS. 5 and 6). As is shown in FIG. 2, a nose bearing 3 is composed of two mating bearing halves 1 which are connected to each other by way of screws (not shown for the sake of simplicity). To this end, the bearing halves 1 are provided with recesses 7 and 9. Each bearing half 1 comprises seven straight, identical, semi-cylindrical and mutually parallel recesses 11, 13, 15, 17, 19, 21 and 23, having a semi-circular cross-section. The recesses 11–23 of the two bearing halves are symmetrically disposed with respect to a vertical line through the centers of circle-cylindrical guide channels 25, 27, 29, 31, 33, 35 and 37 which are formed by joining two exactly mating bearing halves 1 (see FIG. 2).

In each of the two bearing halves 1 of a nose bearing 3 there are also provided two straight, identical, semi-cylindrical recesses 39 and 41 which extend parallel to the recesses 11–23. The recesses 39 and 41 are symmetrically aligned above and below the recesses 11–23, and are also symmetrical with respect to the center vertical line. In the nose bearing 3 assembled from two bearing halves 1 (see FIG. 2), the mating recesses 39 and 41 form channels 43 and 45. Viewed in the vertical direction, the guide channels 25–33 and the channels 43 and 45 virtually adjoin.

The guide channels 25–37 form the individual guides for seven printing pins. For the sake of simplicity, the FIGS. 1 and 2 show only a part of a printing pin 47 in the guide channel 17. In the channels 43 and 45 of the nose bearing 3 (see FIG. 2) there are provided round (pin-shaped) inserts 49 and 51 which are preferably made of the same, comparatively hard material as the printing pins. The printing pins are made of customary, known materials which are comparatively hard in comparison with the material of the nose bearing 3.

Figure 3:
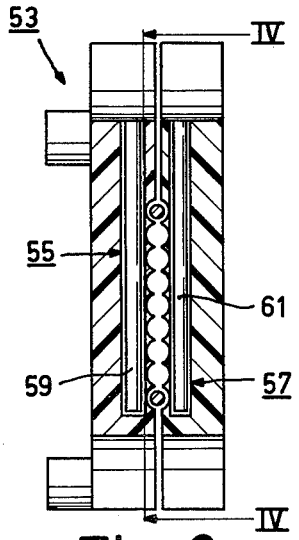
FIG. 3 is a cross-sectional view of a second embodiment of a bearing in accordance with the invention, intended for a printing head in accordance with the invention.
Figure 4:
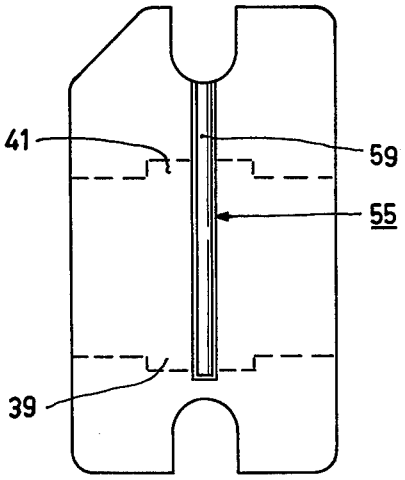
FIG. 4 is a side elevation, taken along the line IV—IV, of one half of the bearing shown in FIG. 3.

A second embodiment of a nose bearing 53 in accordance with the invention, shown in the FIGS. 3 and 4, comprises two further channels 55 and 57 in addition to the channels of the nose bearing 3. For the sake of simplicity, the channels of the nose bearing 53 which correspond to the channels of the nose bearing 3 are not denoted by reference numerals in FIG. 3. The channels 55 and 57 are straight, circle-cylindrical channels which are mutually parallel and which are not formed by mating recesses of the bearing halves of the nose bearing 53. Each of the channels 55 and 57 is situated in its entirety in one of the bearing halves. The channels 55 and 57 extend in a direction transverse to the other channels (25-33 and 43, 45 in FIG. 2). In the channels 55 and 57 there are accomodated respective round (pin-shaped) inserts 59 and 61 which are preferably made of the same comparatively hard material as the printing pins. The channels 55 and 57 are substantially tangent to the circumference of all other channels. As appears from FIG. 4, the channels 55 and 57 extend transversely of the recesses 39 and 41 which are denoted by broken lines. The channels 55 and 57 are situated in a symmetrical position with respect to the vertical line extending through the centers of the other channels, one on each side of this vertical line.

As is shown in the FIG. 2 and 3, the channels 25-37, 43 and 45 of the nose bearings 3 and 53 are in open communication with each other. However, it is alternatively possible for a very small wall thickness to be present between the channels. In the course of the operation of the nose bearings, however, the situation shown in the FIGS. 2 and 3 will always arise. The channels 55 and 57 of the nose bearing 53 are in open communication with the other channels in order to facilitate the introduction of the inserts 59 and 61. However, this is not absolutely necessary.

Figure 5:
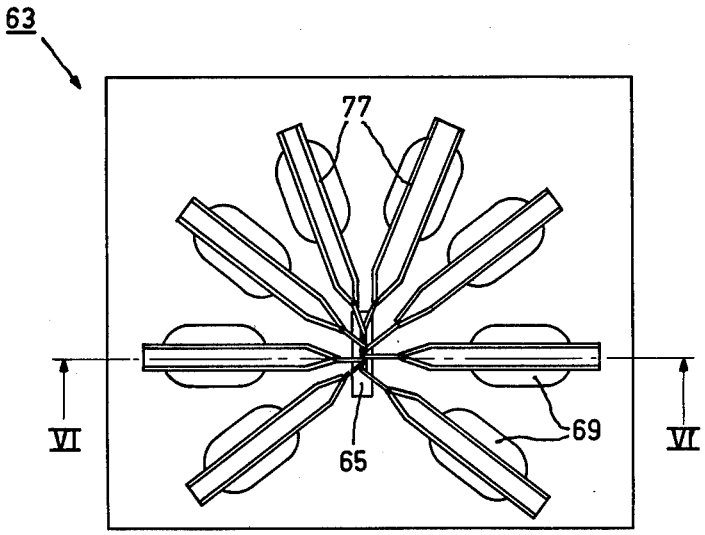
FIG. 5 is a plan view of a printing head in accordance with the invention, comprising a bearing in accordance with the invention.
Figure 6:
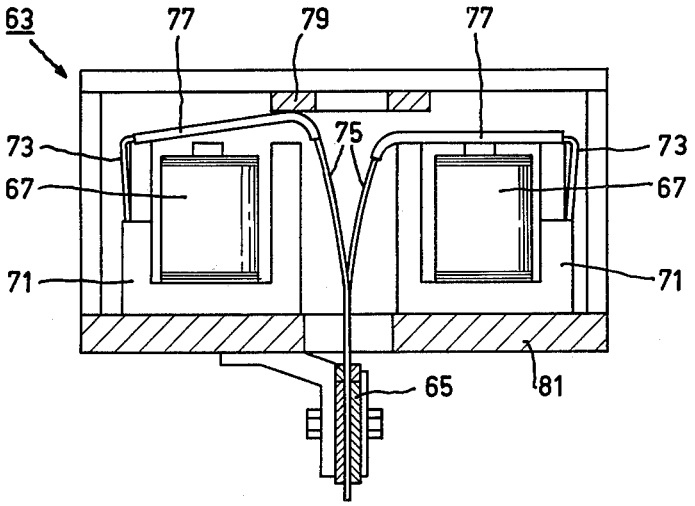
FIG. 6 is a sectional view, taken along the line VI—VI in FIG. 5, of a printing head in accordance with the invention, comprising a bearing in accordance with the invention.

A so-called matrix printing head 63 in accordance with the invention, as shown in FIGS. 5 and 6 and comprising a nose bearing 65 of the type shown in the FIG. 2 or 3, comprises eight electromagnets 67, each of which is provided with an excitation coil 69 and a yoke 71. Each yoke 71 has connected to it a reset spring in the form of a leaf spring 73 for resetting a printing pin 75 after the excitation of a coil 69. Each of the printing pins 75 is connected to a leaf spring 73 by way of an armature 77. The printing head 63 has an abutment 79 for each armature 77. The electromagnets 67 and the nose bearing 65 are mounted on a plate 81. With the exception of the nose bearing 65, the described printing head is of a type which is well known. In the present case, the nose bearing 65 comprises eight guide channels for the eight printing pins 75. The printing pin 75 at the left in FIG. 6 is shown in the rest position, while the right printing 75 is shown in the pin position. FIG. 6 clearly shows that the printing pins 75 move towards the nose bearing 65 along a curved path, which is the cause of wear in the nose bearing 65 due to laterally directed forces.

Even though a bearing in accordance with the invention offers special advantages in a printing head of the kind shown in the FIGS. 5 and 6, in which the printing pins move along partly curved paths, it can be used equally well in known printing heads having parallel, straight printing pins. The number of pin-shaped inserts extending transversely of the guide channels is not always limited to two. Depending on the length of the guide channels among other factors a plurality of inserts can be used on both sides of the printing pins.

I claim:

1. A matrix printer assembly which comprises: a printing head, a plurality of slidable printing pins which are journalled in the printing head and whose printing ends are situated in the vicinity of each other on a straight line which extends transversely of the direction of a line to be printed, means for axially displacing each of said printing pins, and a bearing which can be inserted into the printing head and which comprises an individual, substantially straight guide channel for each printing pin, each printing pin being guided near the printing end thereof, said bearing having a first portion made of a first material and a second portion made of a second material which is harder than said first material, wherein said first portion has at least two substantially straight insert channels formed therein parallel to the guide channels and also disposed on said straight line, viewed in a cross-section of the guide channels, and said second portion includes at least two pin-shaped inserts manufactured of said second material and two insert channels in which said two pin-shaped inserts are respectively disposed, one of the pin-shaped inserts substantially adjoining one outer printing pin, and the other pin-shaped insert substantially adjoining the other outer printing pin, each pin-shaped insert not being connected to said means for axially displacing each of said printing pins.

2. A bearing as claimed in claim 1, wherein the first portion also has at least two transverse channels which extend substantially transversely of the direction of the guide channels, said transverse channels being situated on both sides of the guide channels and aligned tangent to the circumference of the guide channels, and the second portion includes additional transverse pin-shaped inserts located in respective transverse channels.

3. A bearing as claimed in claim 2, wherein the material of the printing pins and the material of the pin-shaped inserts have a substantially equal, high hardness.

4. A bearing as claimed in claim 1, wherein the first portion is divided into two halves symmetrically situated with respect to said straight line, each guide channel being defined by a part of each of said halves, the part of each of the guide channels which is situated on one side of said line mating with the part of the respective channel which is situated on the other side of the said line.

5. A bearing as claimed in claim 4, wherein the material of the printing pins and the material of the pin-shaped inserts have a substantially equal, high hardness.

* * * * *